United States Patent [19]

Ozagir et al.

[11] Patent Number: 4,972,545

[45] Date of Patent: Nov. 27, 1990

[54] DOOR AND HANDLE ASSEMBLY

[75] Inventors: Ozcan Ozagir, Bolton; Raymond Proffitt, Manchester, both of Great Britain

[73] Assignee: Celmac Limited, Manchester, United Kingdom

[21] Appl. No.: 370,706

[22] Filed: Jun. 23, 1989

Related U.S. Application Data

[62] Division of Ser. No. 165,948, Mar. 9, 1988, Pat. No. 4,884,834.

[30] Foreign Application Priority Data

Mar. 13, 1987 [GB] United Kingdom ..... 8705981
Mar. 13, 1987 [GB] United Kingdom ..... 8705982

[51] Int. Cl.[5] ..... A47G 95/02

[52] U.S. Cl. ..... 16/114 R; 16/121; 16/DIG. 24; 16/DIG. 30; 403/297; 403/362

[58] Field of Search ..... 16/121, 118, DIG.24, 16/DIG. 30, 114 R, 117; 292/347, 350; 74/553; 403/297, 362, 368

[56] References Cited

U.S. PATENT DOCUMENTS

| | | |
|---|---|---|
| 16,047 | 11/1856 | Cooley . |
| 62,599 | 3/1867 | Bristol . |
| 533,839 | 2/1895 | Case . |
| 818,565 | 4/1906 | Schwartz . |
| 1,103,963 | 7/1914 | Harlow et al. . |
| 1,799,253 | 4/1931 | Rogers . |
| 2,306,876 | 12/1942 | Gits . |
| 3,758,920 | 9/1973 | Dobrjanskyj et al. . |
| 4,588,221 | 5/1986 | Miller et al. . |

FOREIGN PATENT DOCUMENTS

| | | | |
|---|---|---|---|
| 623434 | 12/1935 | Fed. Rep. of Germany . | |
| 76 | of 1857 | United Kingdom . | |
| 10966 | of 1903 | United Kingdom . | |
| 350665 | 6/1931 | United Kingdom . | |
| 378452 | 8/1932 | United Kingdom . | |
| 550803 | 1/1943 | United Kingdom . | |
| 607176 | 8/1948 | United Kingdom . | |
| 679997 | 9/1952 | United Kingdom . | |
| 802293 | 10/1958 | United Kingdom . | |
| 811149 | 4/1959 | United Kingdom . | |
| 881660 | 11/1961 | United Kingdom . | |
| 894020 | 4/1962 | United Kingdom . | |
| 1143795 | 2/1969 | United Kingdom . | |
| 1230291 | 4/1971 | United Kingdom . | |
| 1345962 | 2/1974 | United Kingdom . | |
| 1345963 | 2/1974 | United Kingdom . | |
| 1541573 | 3/1979 | United Kingdom . | |
| 2099096 | 12/1982 | United Kingdom . | |
| 2103474 | 2/1983 | United Kingdom | 16/121 |
| 2112486 | 7/1983 | United Kingdom . | |

*Primary Examiner*—Richard K. Seidel
*Assistant Examiner*—James Miner
*Attorney, Agent, or Firm*—Nixon & Vanderhye

[57] ABSTRACT

A door and a ceramic handle or knob assembly are disclosed. The ceramic handle has a socket extending from a rear end wall and into the body of the handle. A plastic insert is received in the socket, so that the handle may be secured to the door by means of a threaded bolt, passing into and expanding the plastic insert.

5 Claims, 2 Drawing Sheets

DOOR AND HANDLE ASSEMBLY

This is a division of application Ser. No. 07/165,948, filed Mar. 9, 1988, now U.S. Pat. No. 4,884,834, issued 12-5-89.

FIELD OF THE INVENTION

This invention relates to an assembly of a door and a handle or knob. More particularly, the invention is concerned with making such an assembly using a handle or knob formed of a ceramic material. Such a handle is usually formed in one piece and has a socket extending into the body of the handle

BACKGROUND

A handle may be secured to the door by means of a conventional square section spindle which cooperates with a mortice lock. In a known embodiment a screw passes through a hole in the handle and engages a threaded hole in the spindle. GB-No. 1,541 573 (Lilley) discloses the use of a spindle having a tapered end portion. The handle has a socket to receive the tapered portion of the spindle and a grub screw extends through threads formed in the handle to engage the tapered surface of the spindle. In such a way, the handle and spindle may be easily adapted to fit doors of differing width. It has hitherto proved impossible to fit a ceramic handle to such a spindle. Other handle and spindle assemblies having plastics clip on handles are known See for example GB-No. 1345,962, GB-No. 1,345,963 (Micro and Precision Mouldings Limited) and U.S. Pat. No. 4,588,221 (Miller et al). Secondly, the handle may be secured to a threaded bolt which passes through the door. This is often used to secure handles to e.g. cupboard door. For this purpose, the handle may include a threaded socket to receive the bolt, or in the case of a ceramic handle, may be formed with a nut to engage the bolt. Such a connection is ugly and unreliable.

Other assemblies for providing threads within sockets of e.g. door knobs are known See for example, GB-No. 679,997 (United Carr Fastener Corporation), GB-No. 894,020 (Carr Fastener Company), U.S. Pat. No. 3,758,920 (Dobrjanskyj et al).

It is also known to locate about the hole in the door, a plate to conceal the opening through the door and the screw holes, such that the neck of the handle abuts the plate. The plate may be made of metal or other materials and this invention is particularly concerned when the plate is made of a ceramic material, so as to harmonise with the ceramic handle. Such a plate is known in the UK as a rose.

OBJECTS OF THE INVENTION

It is one object of the invention to provide means by which a handle formed from a ceramic material, may be secured to a door. So that an aesthetically pleasing assembly is formed It is another object to provide the door in such be located between the door and the handle and provide the handle with means to prevent abrasive rubbing between the handle and the rose.

DISCLOSURE OF THE INVENTION

In accordance with one aspect of the invention there is provided a door having a hole therethrough and a handle secured to the door, a through member extending through the hole in the door and into the handle, the handle having a socket to receive a longitudinal portion of the through member, the through member being of relatively reduced cross sectional area so that an annular clearance is present between the inside wall of the socket and the through member, an elongate insert being present in the annular clearance, wherein the handle is formed of a ceramic material and comprises a body portion and a neck portion having a free end wall, and the socket extends inwardly from the free end wall into the body portion, the socket having an open end at the free end wall of the neck portion and a closed end within the body portion, the inside wall of the socket being unthreaded. In one embodiment the elongate insert has a passageway having a substantially smooth inner wall surface and a hole extends through the thickness of the wall, the through member is unthreaded, and a hole extends transversely through the neck portion of the handle, whereby when the holes are aligned and an auxiliary member may be received in the aligned holes, and engaged with the through member. Preferably the hole extending through the wall of the elongate insert is internally threaded and the auxiliary member is externally threaded. Also preferably, the elongate insert has a stepped portion, the socket includes a corresponding depressed portion and the holes are present in the stepped and depressed portions. The through member preferably has a tapered longitudinal portion extending from one end towards the middle and the auxiliary member is engaged with the tapered portion.

In another embodiment, the insert has a through passageway, the longitudinal portion of the through member being provided with external threads and the through passageway of the elongate insert being provided with internal threads whereby the through member is threadingly engaged with the insert. Preferably the wall of the elongate insert at the end remote from the open end of the socket is formed into spring fingers, whereby engagement of the threaded through member with the internally threaded insert urges the spring fingers apart, so as to engage them with the inside wall of the socket In both embodiments the elongate insert preferably includes a flange which is abutted against the free end wall of the neck portion and also preferably a rose is present about the hole of the door through which the through member extends and the flange of the insert is located between the rose and the free end of the neck portion of the handle.

In another aspect of the invention there is provided a handle to be secured to a door, the door having a hole extending therethrough, a through member extending through the hole in the door, the handle comprising the combination of a handle formed of a ceramic material including a body portion, a neck portion having a free end wall, a socket extending inwardly from the free end wall into the body portion, the socket having an open end on the free end wall and a closed end within the body portion, the inside wall of the socket being unthreaded, and also an elongate insert having a through passageway and a flange about one end thereof, the elongate insert being received within the socket, such that the flange abuts the free end wall of the neck portion.

By the term ceramic we mean a material formed by heating a clay or like refractory composition, for example by casting or moulding, usually followed by the application of a glaze or like attractive finish and often painted. The nature of the materials and the methods used makes it difficult to provide a socket having a threaded wall so that the handle formed can be reliably engaged with a threaded through member.

BRIEF DESCRIPTION OF THE DRAWINGS

Other objects and may of the attendant advantages of this invention will be readily appreciated as the same becomes better understood by reference to the following detailed description when considered in connection with the accompanying drawings wherein.

DESCRIPTION OF THE INVENTION

Figure 1:
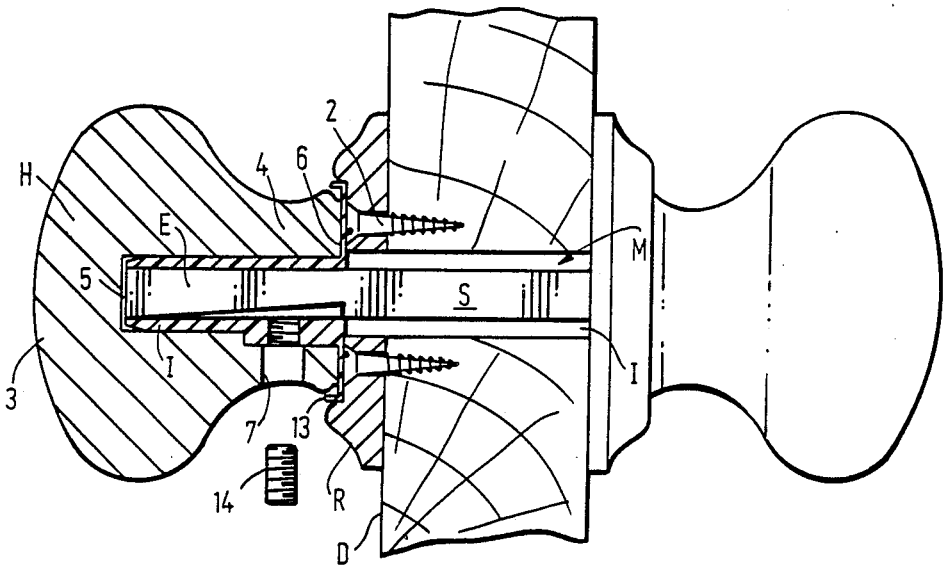
FIG. 1 is a sectional view of a door and knob assembly according to one embodiment of the invention.

Referring now in great detail to the various figures and drawings, wherein like reference characters refer to like parts, there is shown in FIG. 1, a portion of a wood door D having a through hole 1 which extends between opposite faces. A generally disc-shaped rose R is present on each face of the door D about the hole 1 and is held to the door by screws 2. The rose R has hole through which a through member such as a spindle may pass. The catch of a mortice lock M (not shown) is present in the door and is moved by means of the through member, or spindle S, in known manner. The spindle S extends through the hole 1 between the front and rear faces of the door.

The spindle S has longitudinal handle receiving end portions E which project beyond the door faces. The end portions E taper towards the hole 1. The spindle S is square in cross-section.

Figure 2:
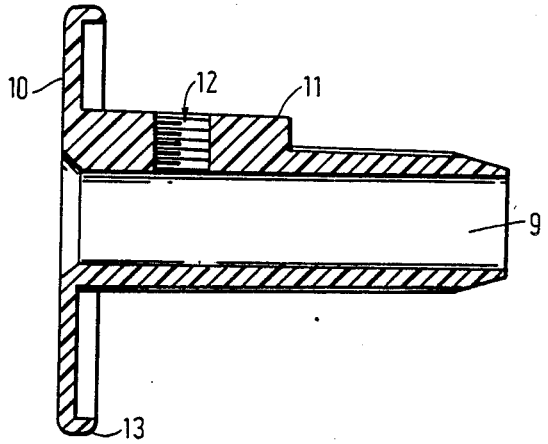
FIG. 2 is an enlarged sectional view of the insert of FIG. 1.

A handle H is cast in one piece of ceramic material and has a bulbous head portion 3 and a neck portion 4. A socket 5 extends from the flat end face 6 of the neck portion 4 into the head portion 3. The socket 5 has a shape complementary to that of the spindle but is slightly larger. A small hole 7 to receive a grub screw 14 extends from one side of the neck portion 4 into the socket 5. The grub screw 14 functions as an auxiliary member. The handle is free of holes apart from the socket 5 and the screw hole 7 and presents an aesthetically pleasing appearance and has a smooth attractive feel An insert I (best shown in FIG. 2) comprises a plastics moulding, e.g. polyacetal and having a flat base portion 10 and an elongate shank portion 11. The insert I is received in the socket 5 of the handle H with the basal portion 10 abutted against the flat end wall 6 The shank portion 11 has a small threaded hole 12, in axial alignment with that of the handle. The hole 12 is present in a stepped portion of the shank portion 11 and there is a corresponding depression in the wall of the socket As a result, the insert I may only be inserted one way into the socket 5. The basal portion 10 has a circular rim or lip 13, which surrounds the rim of the neck end wall 6 A passageway 9 extends through the insert between the basal portion 10 and the shank portion 11.

In use the spindle S is passed through the hole 1 in the door. The insert I is urged into the socket 5 of the handle H and then pushed on to a spindle end portion E to cause the insert base portion 10 to abut the rose R. A grub screw 14 is then located in the aligned holes 7, 12 to bear on the taper surface of the spindle end portion E. The same process is then repeated to locate the other handle H in position Rotation of the handle H will rotate the spindle S to release the door from its frame. Because of the basal portion 10 there will not be abrasive rubbing of the handle against the rose R; because of the precise positive engagement of the screw 14 through the hole 12 with the spindle end portion E, there will be no play between the parts and the handle. The assembly is preferably arranged so that the aligned holes 12 are on the underside of the handle when in position as shown in FIG. 1. In this way the ceramic handle assembly conceals the unsightly grub screw 14.

Figure 3:
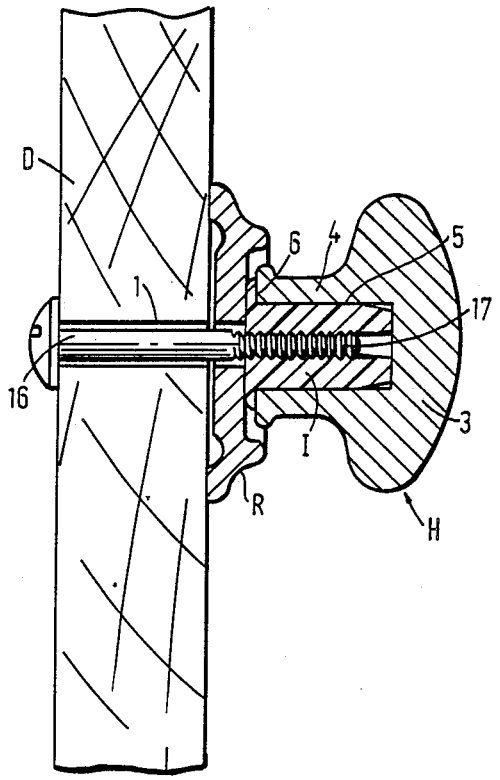
FIG. 3 is a sectional view of a door and knob assembly according to another embodiment of the invention.
Figure 4:
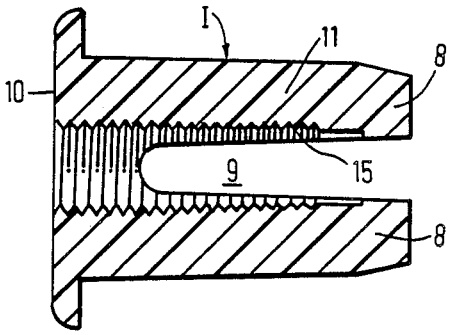
FIG. 4 is an enlarged sectional view of the insert of FIG. 3.

FIG. 3 shows another embodiment of the invention. A wooden door D has a through hole 1 which extends between opposite faces A rose R is present on the front face of the door about the hole 1. A handle H is cast in on piece from ceramic material and includes a bulbous head portion 3 and neck portion 4. A socket 5 extends from the free end wall 6 of the neck portion 4, and into the head portion 3, as before. The insert I is formed of a plastics material, e.g. a polyacetal, and comprises a flat annular basal portion 10 and a shank portion 11. The shank portion 11 is generally square in cross-section and has spring fingers 8. A bore or passageway 9 extends from the base portion 10 and through the shank portion 11. The bore 9 has internal threads 15.

In use, the hole is drilled in the door D. The insert I is pushed home into the socket 5 of the handle, until the basal portion 10 abuts the flat end wall 6 thereof.

The handle H and the rose R are offered up to the door D, and an elongate member in the form of a bolt 16 having a threaded end portion 17 is urged through the hole 1 from the rear surface thereof. The bolt is then screwed to engage the threads 15 in the insert I. The bolt 16 is urged home until the handle and rose are firmly held to the doors front face.

The ceramic handle and the rose when fitted to a door, are especially smooth and attractive both to use, and in outward appearance.

Both assemblies are easy to make and the connections are secure. The basal portion 10 prevents frictional abrasion between the rose and the handle. The handles may be removed from the door many times, without wear occurring on the insert

What is claimed is:

1. A door having a hole therethrough, an elongate member extending through the hole, the member having an externally threaded length portion, a ceramic handle including a body portion and a neck portion having a free end wall, an elongated insert formed from a plastic material, the outer diameter of said insert being the same as the inner diameter of said socket whereby said insert is received within the socket, a through passageway extending through the insert and having internal threads along substantially the entire length thereof, the insert having spring fingers which have outermost side surfaces extending substantially from the free end wall of the handle along substantially the entire length of the insert, the externally threaded length portion of said member having an outer diameter greater than the inner diameter of the internally threaded passageway of said insert, the handle being engaged with the member by engagement of the threaded length portion and the internal threads of the insert, the engagement urging the spring fingers apart so as to urge the outermost side surfaces thereof substantially along the entirety of their lengths into frictional engagement with the inside wall of the socket along substantially the entire length thereof whereby said frictional engagement forms the sole means connecting the handle and insert one to the other and retaining the handle and insert connected one with the other.

2. A door according to claim 1, wherein the insert includes a flange which abuts the free end wall of the handle.

3. A door according to claim 2, wherein a rose is present between the handle and the door.

4. A door according to claim 3, wherein the socket and the insert therefor are of square or like non-circular section.

5. For use with a door having a hole therethrough, a kit of parts comprising an elongate member having an externally threaded length portion to be received in the hole, a ceramic handle comprising a body portion and a neck portion having a free end wall, a socket having a blind end extending into the handle from the free end wall, an elongated insert formed from a plastic material the outer diameter of said insert being substantially the same as the inner diameter of said socket whereby said insert is receivable within the socket, a through passageway extending through the insert and having internal threads along substantially the entire length thereof, the insert having spring fingers which have outermost side surfaces extending along a substantial majority of the length portion of the insert, the externally threaded length portion of said member having an outer diameter greater than the inner diameter of the internally threaded passageway of said insert the parts being arranged so that when the insert is received within the socket, with the spring fingers facing towards the blind end of the socket, engagement of the threaded member with the internal threads of the passageway, urges the spring fingers apart so as to urge said outermost side surfaces into frictional engagement with the inside wall of the socket along substantially the entire length thereof whereby said frictional engagement forms the sole means connecting the handle and insert one to the other and retaining the handle and insert connected one with the other.

* * * * *